US006550636B2

(12) United States Patent
Simpson

(10) Patent No.: US 6,550,636 B2
(45) Date of Patent: Apr. 22, 2003

(54) SHEET DISPENSER

(75) Inventor: Raymond Simpson, Oak Park, IL (US)

(73) Assignee: Menasha Corporation, Neenah, WI (US)

( * ) Notice: Subject to any disclaimer, the term of this patent is extended or adjusted under 35 U.S.C. 154(b) by 77 days.

(21) Appl. No.: 09/761,010

(22) Filed: Jan. 15, 2001

(65) Prior Publication Data

US 2002/0092859 A1 Jul. 18, 2002

(51) Int. Cl.[7] ..... B65H 1/00

(52) U.S. Cl. ..... 221/59; 271/145; 271/160; 221/56; 211/51; 206/559

(58) Field of Search ..... 267/165, 182; 271/145, 160; 221/46, 56, 58, 59, 52; 211/51; 206/559

(56) References Cited

U.S. PATENT DOCUMENTS

| | | | | |
|---|---|---|---|---|
| 2,027,671 A | | 1/1936 | Broeren | 312/62 |
| 2,237,424 A | | 4/1941 | Hope | 312/62 |
| 2,253,742 A | | 8/1941 | West et al. | 312/62 |
| 2,634,855 A | * | 4/1953 | Mandel | 221/59 |
| 4,588,093 A | * | 5/1986 | Field | 211/51 |
| 4,993,590 A | | 2/1991 | Windorski | 221/46 |
| 5,165,570 A | | 11/1992 | Windorski et al. | 221/46 |
| 5,197,631 A | * | 3/1993 | Mishima | 221/56 R |
| 5,363,985 A | | 11/1994 | Cornell | 221/46 |
| 5,390,820 A | | 2/1995 | Wright et al. | 221/52 |
| 5,979,699 A | | 11/1999 | Simpson | 221/52 |
| 5,979,700 A | * | 11/1999 | Suess | 221/56 |

FOREIGN PATENT DOCUMENTS

| | | | |
|---|---|---|---|
| EP | 0253308 | 1/1988 | 221/33 |

* cited by examiner

*Primary Examiner*—Frank E. Werner
(74) *Attorney, Agent, or Firm*—Quarles & Brady LLP

(57) ABSTRACT

A sheet article dispenser includes a housing and a double-acting spring designed to urge a stack of sheet articles toward an access opening in the housing to allow only the outermost sheet to be removed one at a time. The double-acting spring includes a thin flexible panel and a resilient band. The panel has opposite ends flanking a middle section. The ends each have a pair of lateral notches at opposite edges for receiving the resilient band. The ends are flexed inwardly to form an S-shaped structure with arcuate surfaces on each side of the middle section that can deform elastically.

12 Claims, 1 Drawing Sheet

SHEET DISPENSER

CROSS-REFERENCE TO RELATED APPLICATION

Not applicable.

STATEMENT REGARDING GOVERNMENT SPONSORED RESEARCH OR DEVELOPMENT

Not Applicable.

BACKGROUND OF THE INVENTION

The present invention relates to a dispenser of individual sheet articles.

Devices have been developed for dispensing one at a time various paper sheets, for example, note sheets or promotional materials, such as coupons and rebates. These devices usually comprise some type of container for holding a stack of many sheets. The container typically has an opening or slit through which only the top sheet fits. A person can than easily grasp and remove the single sheet protruding from the container without inadvertently removing one or more other sheets.

These devices ordinarily include a spring element disposed in the container beneath the stack of sheets to urge the sheets toward the opening, such as disclosed in U.S. Pat. Nos. 2,027,671; 2,253,742; 5,165,570; and 5,363,985. The spring element is designed to support the stack of sheets so that the outermost sheet extends into the opening. The spring also raises the stack as needed after each successive sheets is removed.

The sheets are coupled in such a way that the as the outermost sheet pulls the second outermost sheet into the opening. Typically, the sheets are folded and interleaved with adjacent sheets, such as in a box of tissues. Or in the case of note sheets, the sheets may be adhered to adjacent sheets at alternating edges. This interleaving or adherence requires additional assembly steps for the manufacturer and prevents the end user from refilling the dispenser with non-coupled sheets.

U.S. Pat. No. 5,979,699 discloses a spring-biased dispenser for non-coupled sheets. The sheets in this case are generally rectangular with one folded over end. This dispenser is designed to be inexpensive for use in retail stores at the point of purchase to dispense coupons. To that end, the container is made of a low-cost pulp and the spring is a plastic sheet flexed about 180 degrees.

While this provides a very effective, yet simple and inexpensive, dispenser, the spring is subject to setting (plastic deformation) in the bended region after prolonged periods of use. Once this occurs, the spring rate can be substantially reduced such that the spring cannot sufficiently support the stack of sheets at the opening in the container.

Accordingly, an improved low-cost dispenser spring is needed.

SUMMARY OF THE INVENTION

The invention provides a sheet article dispenser having a housing with a top opening for accessing an outermost sheet article of a stack of generally uniform sheet articles facing the top opening of the housing. Within the housing and beneath the stack of sheets is the spring. The spring includes a thin flexible panel and a band fit around the panel forming an arcuate structure that can be elastically deformed. The spring urges the stack of sheet articles toward the top opening. This allows only the outermost sheet article to be removed one at a time by lifting the folded end and pulling the outermost sheet article through the top opening.

In a preferred form, the spring is a double acting spring. The panel is a thin plastic panel having opposite ends flanking a middle section narrower than the ends. The ends each have a pair of lateral notches at opposite edges. The ends are flexed toward the middle section in the same direction so as to form a structure with an arcuate surface on each side of the middle section that can deform elastically. Preferably, the panel can include pre-formed fold lines at the ends of the middle section for facilitating bending the ends.

The panel can be a plastic and the band can be resilient material, such as rubber or elastic, and preferably, the band is a suitably sized conventional rubber band.

Thus, the invention provides an inexpensive sheet dispenser with a pulp container, a plastic panel and a rubber band. The resilient band increases the spring rate and reduces the occurrence and adverse effect of setting on the spring. Additionally, the occurrence and effect of setting is further reduced because there are two arcuate portions of the panel that provide the spring force and these arcuate portions are flexed only about 90 degrees. Limiting the angle of flex reduces the strain in the bending regions of the material and thereby prolongs the onset of plastic deformation.

The foregoing and other advantages of the invention will appear from the following description. In this description, reference is made to the accompanying drawings which form a part hereof and in which there is shown by way of illustration a preferred embodiment of the invention. This embodiment does not represent the full scope of the invention. Thus, the claims should be looked to in order to ascertain the scope of the invention.

DETAILED DESCRIPTION OF THE PREFERRED EMBODIMENT

Figure 1:
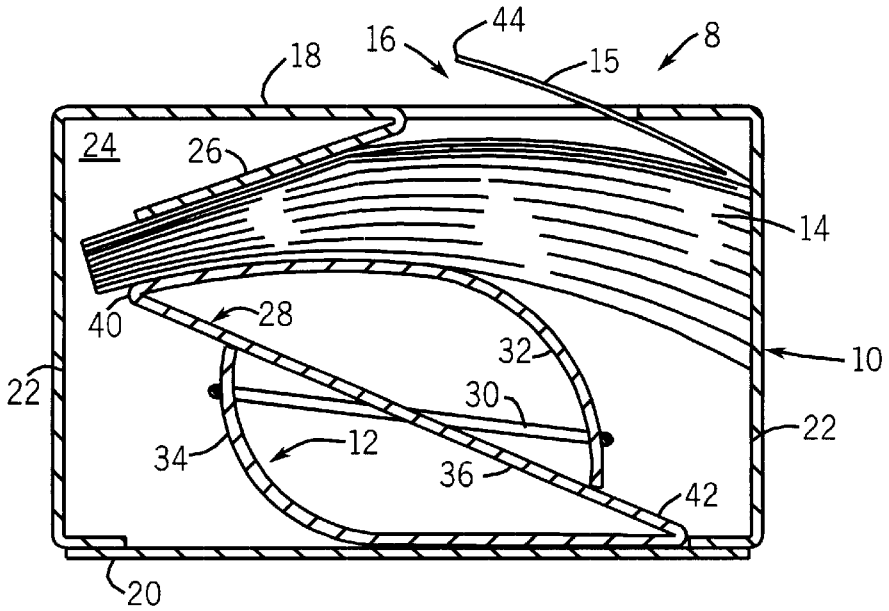
FIG. 1 is a front view of the spring dispenser of the present invention.

Referring to FIG. 1, a sheet dispenser 8 includes a housing 10 containing a spring 12 that supports and urges a stack of sheet articles 14 toward a top opening 16 in the housing. The sheet articles 14 are generally rectangular paper sheets with one folded over end 15. The folded sheets are stacked individually on top of each other in the same orientation without interleaving the sheets. The sheet articles 14 can include printed indicia and designs. The dispenser 8 can be used, for example, to dispense promotional advertisements and product-related materials, such as coupons, at the point of purchase in retail stores. The dispenser box and sheet articles are preferably as disclosed in U.S. Pat. No. 5,979,699, assigned to the assignee of the present invention and hereby incorporated by reference as though fully set forth herein.

The housing 10 has a top 18, bottom 20, ends 22 and sides 24 (one shown). The housing walls are rectilinear and are joined by any suitable means, such as by applying an adhesive. The housing 10 can be made of any suitable material; a low cost pulp is preferred. Although not shown as such, the housing 10 can be made with a removable top having side walls overlapping the side and end walls of an open bottom half. In any event, the generally rectangular upper opening 16 is cut out of the top 18 on three sides and the remaining tab 26 is folded down inside the housing 10.

Figure 2:
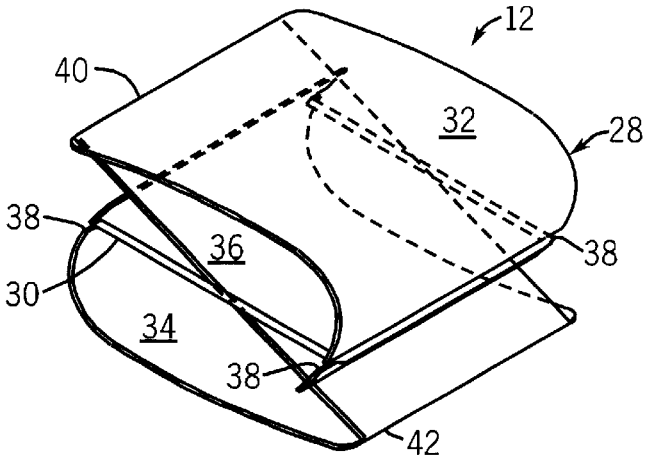
FIG. 2 is a perspective view of the spring.

Referring to FIG. 2, the spring 12 is composed of two components; namely a thin-plastic panel 28 (e.g., 0.020 PETG) and a resilient band 30. The band 30 is preferably a stretchable loop such as a rubber band. As shown flat in FIG. 3, the panel 28 is dumb-bell shaped with two ends 32 and 34 flanking a narrower middle section 36. Each end includes a pair of lateral notches 38. Preferably, creased fold lines 40 and 42 are formed in the panel 28 at the ends of the middle section 36 to facilitate bending of the ends 32 and 34.

Figure 3:
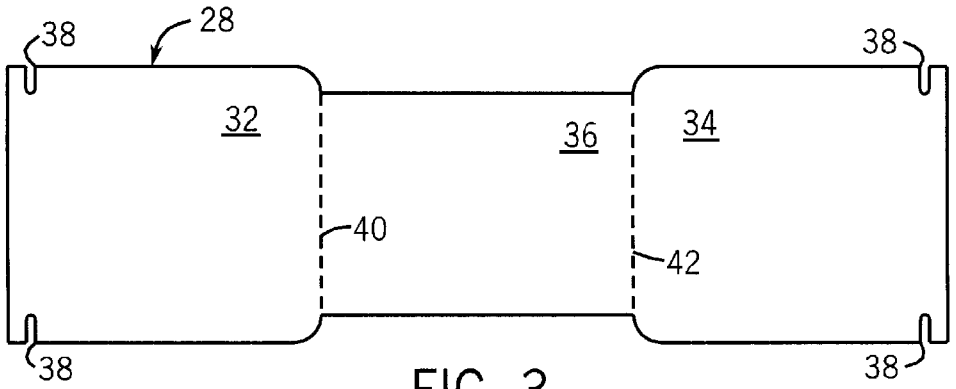
FIG. 3 is a plan view of a blank for the spring of FIG. 2.

Referring to FIGS. 2 and 3, the spring 12 is assembled by creasing end 32 and bending it into arcuate form about fold line 40 in a clockwise direction and creasing end 34 and bending it into arcuate form about fold line 42 in a clockwise direction. This makes the spring generally S-shaped, as shown in FIGS. 1 and 2. Then, the band 30 is fit into the pair of notches 38 in the end 34, stretched over the top of end 32 and fit in the pair of notches in end 32. In this way, the band 30 lies on opposite faces of the panel at each end and extends between the ends without contacting the middle section 36 due to its decreased width. This forms a double-acting spring structure with an arcuate surface on each side of the middle section 36. The arcuate surfaces can be elastically deformed independent of one another. The band 30 supplies opposing inward forces on the ends 32 and 34 to maintain the arcuate surfaces and resist flattening of the panel 28.

In use, the spring 12 is set inside the housing 10, preferably before one of the ends 22 is secured in place, so that the lower arcuate surface formed by end 34 rests on the bottom 20 and the upper arcuate surface formed by end 32 is beneath the top opening 16. The sheet articles 14, piled in a stack in the same orientation (without being interleaved), are laid on the top arcuate surface with the folded ends 15 facing up and generally beneath the top opening 16. The stack of sheet articles 14 will be thinner at the non-folded ends and will fit between the spring and the folded under tab 26, as shown in FIG. 1.

The spring 12 will thus contact the bottom of the stack of sheet articles 14 and compress the spring slightly by deforming each of the arcuate surfaces. The spring 12 will urge the stack of sheet articles 14 upward toward the top opening 16. Preferably, the spring 14 will apply the greatest upward force on the stack near a free edge 44 of the folded ends 15 of the sheet articles 14. This, in combination with the stack being urged against the top 18 of the housing 10 on each side of the top opening 16, causes the stack to bend slightly convexly. This acts to lift up the free edge 44 of the folded end 15 of the outermost sheet article. The outermost sheet article can be removed from the dispenser 8 by grasping the folded end 15 between an index finger and thumb. The outermost sheet article can be removed one at a time without the chance of one or more other sheets also being removed inadvertently. As each outermost sheet article is dispensed, the spring urges the stack upward so that the next outermost sheet can be removed.

Thus, the invention provides an inexpensive sheet dispenser. The container can be made of a low-cost pulp and the spring can be constructed of a simple rubber band and sheet of flexible plastic. Additionally, the dispenser can be shipped collapsed and be easily assembled by the end user, thereby further decreasing assembly and shipping costs.

Moreover, the resilient band increases the rate of the spring and reduces the occurrence and adverse effect of setting on the spring. In the first embodiment, the occurrence and effect of setting is further reduced because there are two arcuate portions of the panel that provide the spring rate and these arcuate portions are flexed only about 90 degrees. Limiting the angle of flex reduces the material strain in the bending regions and thereby prolongs the onset of plastic deformation.

While there has been shown and described what is at present considered to be the preferred embodiment of the invention, it will be obvious to those skilled in the art that various changes and modifications can be made to the described device without departing from the scope of the present invention. Accordingly, to ascertain the full scope of the invention, reference must be had to the following claims.

What is claimed is:

1. A sheet article dispenser, comprising:

a housing having walls defining a cavity and an opening for accessing an outermost sheet article of a stack of generally uniform sheet articles facing the opening of the housing; and a double-acting spring disposed within the housing beneath the stack of sheet articles, the spring having a thin flexible panel and an elastic band engaging opposite ends of the panel so as to provide opposite inward forces on the ends and form two curved sections with opposite concavity that can be elastically deformed independently;

wherein the spring urges the stack of sheet articles toward the opening in the housing to facilitate removal of only the outermost sheet article one at a time by lifting the folded end and pulling the outermost sheet article through the opening.

2. The sheet article dispenser of claim 1, wherein the opposite ends of the panel have opposing notches and wherein the band is disposed through the notches.

3. The sheet article dispenser of claim 2, wherein the panel is generally rectangular when flat.

4. The sheet article dispenser of claim 3, wherein the curved sections are formed by flexing the opposite ends of the panel toward each other.

5. The sheet article dispenser of claim 2, wherein the panel includes a middle section between the opposite ends so as to make the spring generally S-shaped.

6. The sheet article dispenser of claim 5, wherein the curved surfaces are formed by bringing the opposite ends toward the middle section in the same rotational direction.

7. The sheet article dispenser of claim 6, wherein the panel includes fold lines at each end of the middle section to facilitate bending of the opposite ends.

8. The sheet article dispenser of claim 6, wherein the panel is plastic and the band is a rubber band.

9. The sheet article dispenser of claim 1, wherein the stack of sheet articles within the housing is non-interleaved.

10. The sheet article dispenser of claim 9, wherein the sheet articles have folded ends at the same end of the stack.

11. A sheet article dispenser, comprising:

a housing having walls defining a cavity and an opening for accessing an outermost sheet article of a stack of generally uniform sheet articles each having an end at the same end of the stack and facing the opening of the housing; and a double-acting spring disposed within the housing beneath the stack of sheet articles, the spring having:

a thin plastic panel having opposite ends flanking a middle section narrower than the ends, the ends each having a pair of lateral notches at opposite edges, the ends being flexed toward the middle section in the same direction so as to form a generally S-shaped structure with curved sections on each side of the middle section that can deform elastically;

a resilient band disposed through the notches to maintain the S-shaped structure;

wherein the spring urges the bottom of the stack of sheet articles toward the opening in the housing to facilitate removal of only the outermost sheet article one at a time by pulling the outermost sheet article through the opening.

12. The sheet article dispenser of claim 11, wherein the panel includes fold lines at each end of the middle section to facilitate bending of the opposite ends.

* * * * *